United States Patent [19]

Diemer

[11] Patent Number: 4,987,723

[45] Date of Patent: Jan. 29, 1991

[54] METHOD AND APPARATUS FOR STRIPPING TAGS FROM DIE CUT SHEETS

[75] Inventor: Gordon J. Diemer, Grand Ledge, Mich.

[73] Assignee: The John Henry Company, Lansing, Mich.

[21] Appl. No.: 320,990

[22] Filed: Mar. 9, 1989

[51] Int. Cl.[5] ..... B65B 13/02

[52] U.S. Cl. ..... 53/399; 53/135; 53/414; 53/586; 225/101

[58] Field of Search ..... 53/414, 435, 438, 135, 53/134, 520, 513, 528, 399, 586; 225/101, 100, 97

[56] References Cited

U.S. PATENT DOCUMENTS

| | | | |
|---|---|---|---|
| 1,268,919 | 6/1918 | Bleile | 225/101 |
| 1,598,879 | 9/1926 | Ranney et al. | 225/101 X |
| 2,761,505 | 9/1956 | Greiner et al. | 225/101 |
| 2,993,314 | 7/1961 | Havemann et al. | 225/101 X |
| 2,998,134 | 8/1961 | Gray | 209/90 |
| 3,239,116 | 3/1966 | Hulak | 225/97 X |
| 3,708,094 | 1/1973 | Koether et al. | 225/103 |
| 3,883,056 | 5/1975 | Landes et al. | 225/104 |
| 3,895,751 | 7/1975 | Shepherd | 225/3 |
| 4,136,604 | 1/1979 | Schmidt | 225/101 X |
| 4,500,022 | 2/1985 | Lucas | 225/97 |
| 4,552,291 | 11/1985 | Schott | 225/96.5 |
| 4,646,954 | 3/1987 | Happ | 225/2 |

*Primary Examiner*—James F. Coan

*Attorney, Agent, or Firm*—Price, Heneveld, Cooper, DeWitt & Litton

[57] ABSTRACT

A method for producing bundles of tags from a stack of die cut sheets and an apparatus for stripping bundles of tags from a stack of die cut sheets and tying the bundles. The disclosed method includes clamping portions of a stack of die cut sheets on opposite sides of a common cut line adjacent the cut line and rotating the portions about the common cut line with respect to each other about an axis parallel to the cut line. The method causes the portions to separate sequentially for individual sheets in order to substantially reduce the stripping force required. The method may further include imparting a force in a direction transverse the sheets during the rotating to further enhance the sequential separation of the sheet portions. An apparatus is disclosed including gravity feed means for feeding stacks of sheets into a dual stripping assembly having alternatingly-actuated stripping members. The disclosed apparatus further includes a tying assembly including a pushing member for pushing stripped tag bundles into a wire segment and a rotatable twisting member for snaring and twisting the ends of the wire segments which face the twisting member.

29 Claims, 8 Drawing Sheets

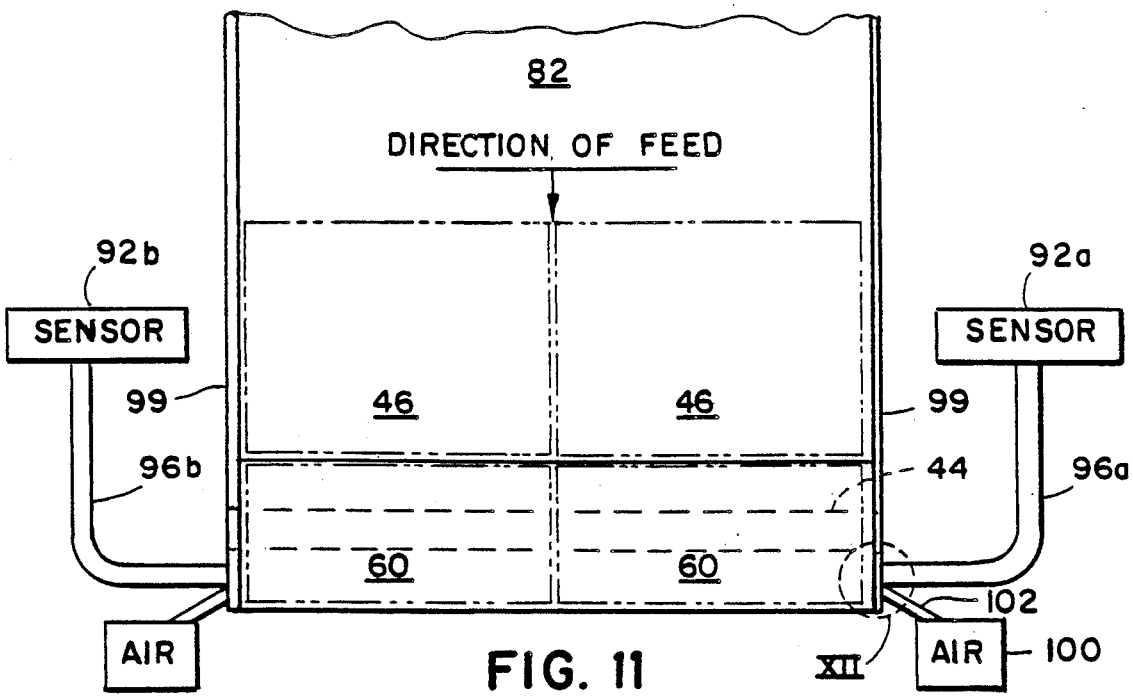
FIG. 11
FIG. 12
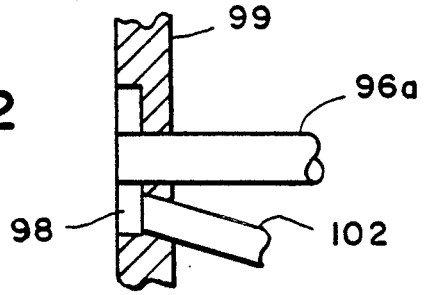
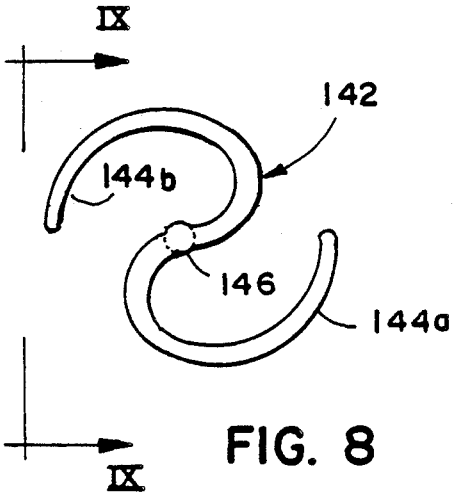
FIG. 8
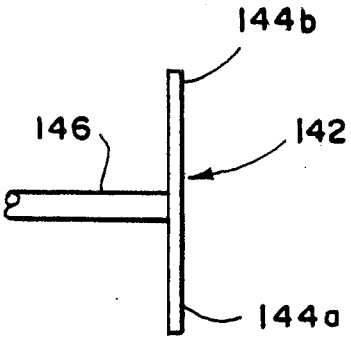
FIG. 9

METHOD AND APPARATUS FOR STRIPPING TAGS FROM DIE CUT SHEETS

BACKGROUND OF THE INVENTION

This invention relates to a method and apparatus for stripping blanks, such as plant identification tags, from sheets containing many such tags that are partially separated by die cutting and in particular to such a method and apparatus for stripping bundles of such blanks or tags from a stack of such sheets and tying each bundle.

Plant identification tags, or other like planar articles, are typically manufactured by die cutting sheets of material into individual blanks connected by bridges. After the die cutting operation, the blanks remain mutually attached in sheets by the bridges to facilitate removal of the blanks from the die cut press. In order to separate the blanks from adjacent blanks, the sheets are conventionally stacked in quantities of as much as one hundred or more sheets and bundles of blanks are removed from the stack of sheets by applying a force perpendicular to the plane of the sheets to the location of the cut line.

Such conventional method and apparatus for stripping tags have many difficulties. The very large stripping thrust requires strong, and hence massive, components operated at relatively high pneumatic or hydraulic pressures. The resulting equipment is bulky yet subject to excessive wear notwithstanding such bulk. Modern safety standards require that such equipment be shielded from entanglement by human limbs. However, the stripping equipment is prone to malfunctioning due to disassociation of the bundle of tags, which interface with low-friction surfaces. The disassociation disables the equipment and requires human intervention to remove the jam. The presence of the safety shields and the large profile of the equipment result in extensive downtime to clear each jam. The net result is that productivity from such conventional stripping equipment is unacceptably low and maintenance costs unacceptably high.

SUMMARY OF THE INVENTION

It is an object of the present invention to provide a tag stripping method that may be practiced by a compact apparatus that requires significantly less stripping force than the conventional stripping apparatus. A method for producing batches of tags from a stack of die cut sheets according to the invention includes clamping a stack of die cut sheets at two portions on opposite sides of a cut line and rotating one portion with respect to the other portion in order to sequentially separate individual sheets at the cut line. An apparatus for severing tags of a stack of die cut sheets according to the invention includes first clamping means for clamping a stack of die cut sheets on one side of a cut line, second clamping means for clamping a batch of die cut sheets on the opposite side of the cut line and means for rotating one of the clamping means with respect to the other clamping means about an axis that is generally parallel to the plane of the sheets in order to sequentially separate individual sheets at the cut line.

These and other related objects, advantages and features of this invention will become apparent upon review of the following specification in conjunction with the drawings.

BRIEF DESCRIPTION OF THE DRAWINGS

FIG. 1*a* illustrates a stack of die cut sheets to which the present invention is applied;

FIG. 1*b* illustrates tied bundles of tags produced by the present invention;

FIG. 8 is an enlarged elevational view taken along the lines VIII-VIII in FIG. 7;

FIG. 9 is an enlarged elevational view as observed along the lines IX-IX in FIG. 8;

FIG. 11 is a plan view of the stripping area of the apparatus illustrated in FIG. 2; and FIG. 12 is an enlarged partial view of the portion of FIG. 11 indicated by XII.

DESCRIPTION OF THE PREFERRED EMBODIMENT

Figure 2:
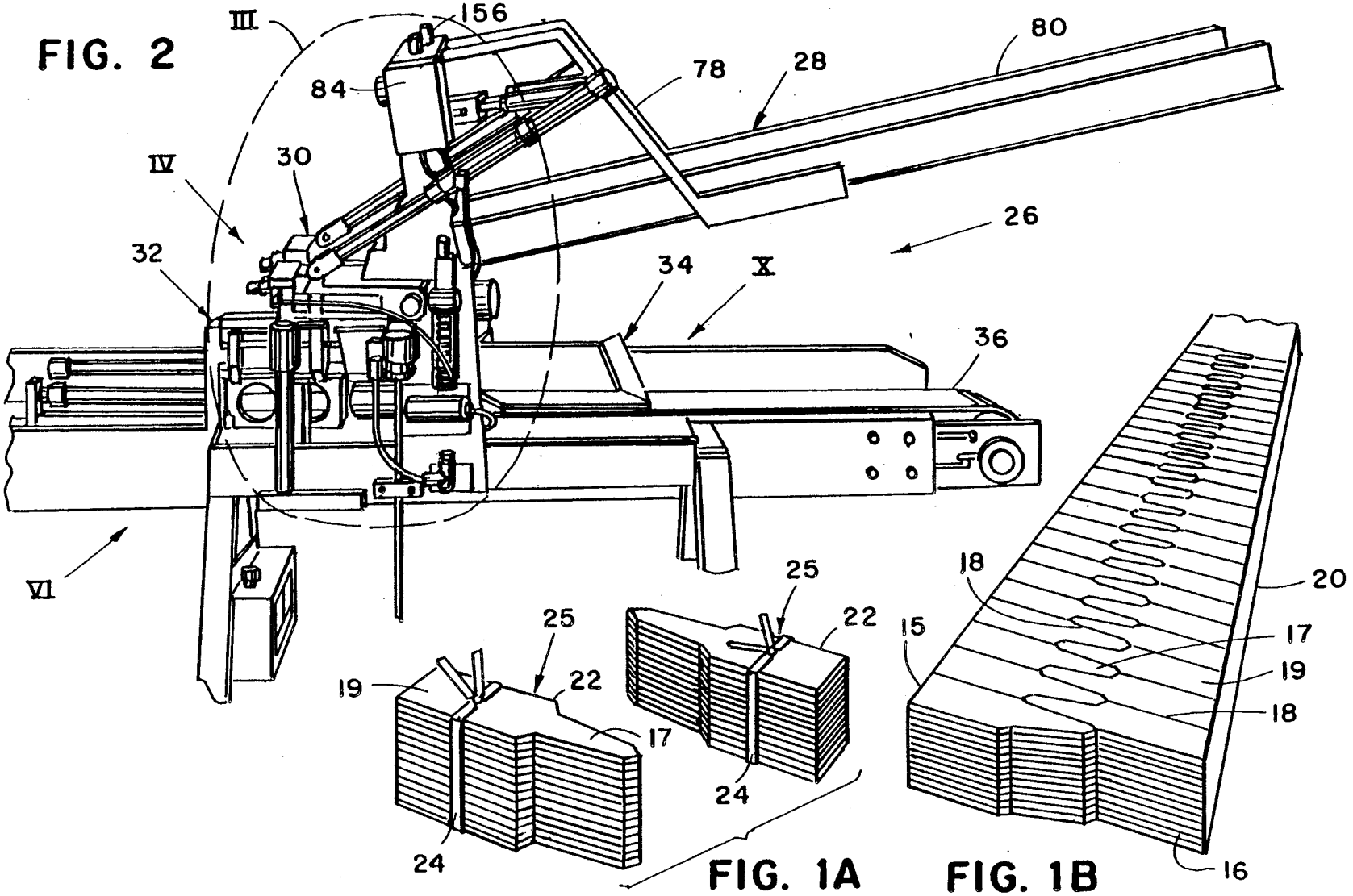
FIG. 2 is an elevational view taken from the right side of an apparatus embodying the invention.
Figure 3:
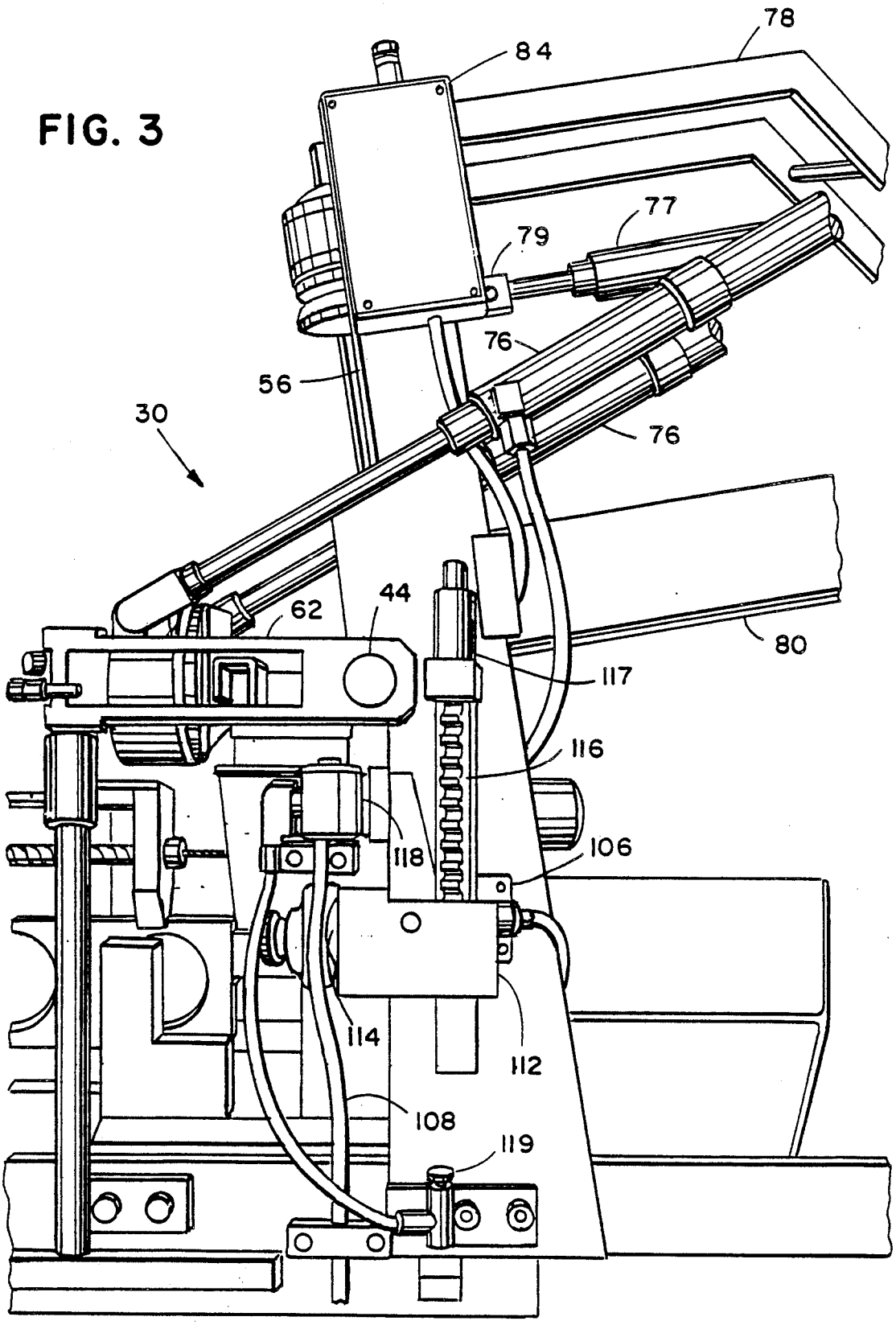
FIG. 3 is an enlarged partial view of the portion of FIG. 2 indicated at III.
Figure 4:
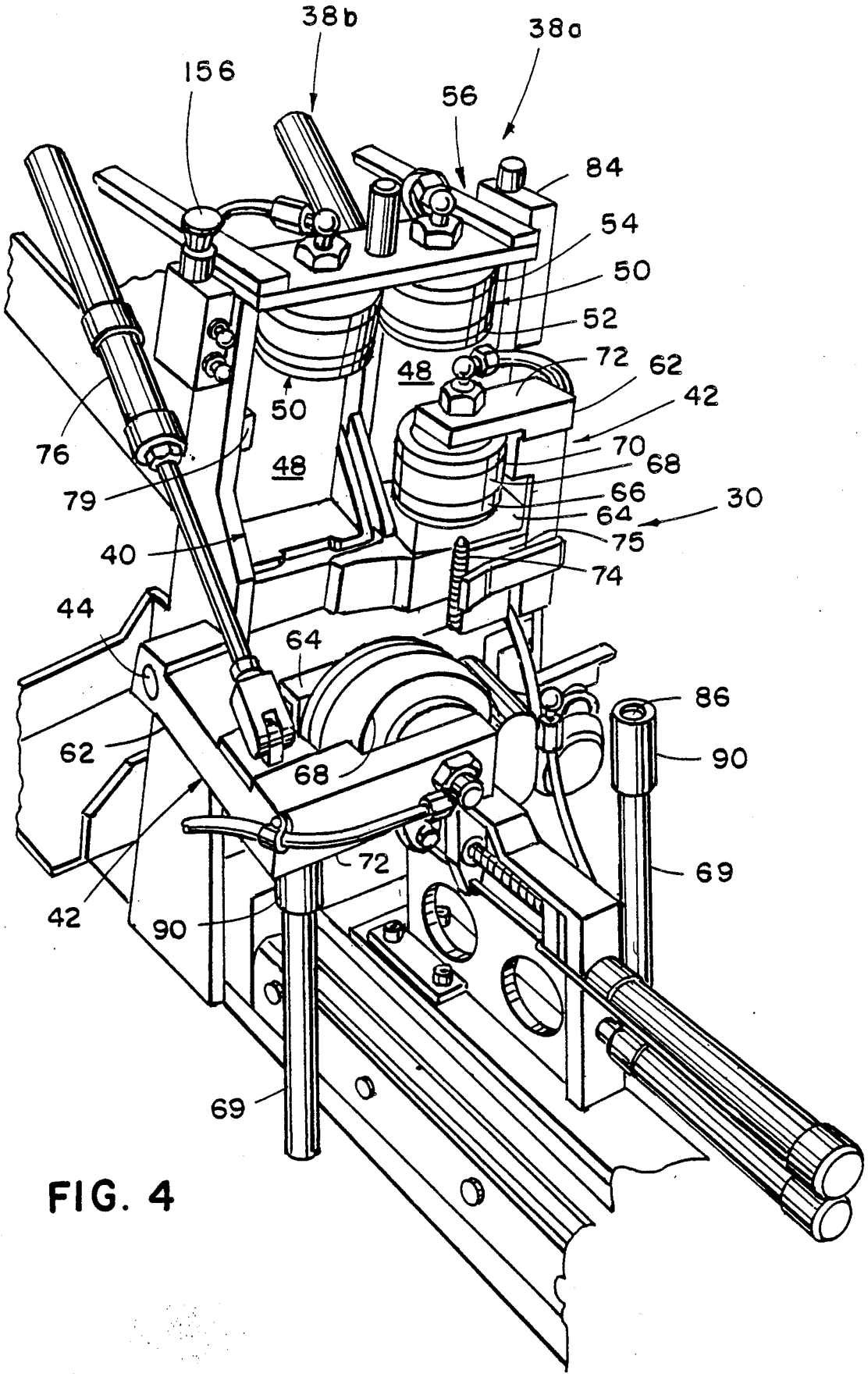
FIG. 4 is a partial perspective view of the left front side of the apparatus in FIG. 2 as observed along the line IV in FIG. 2.

Referring now specifically to the drawings, and the illustrated embodiments depicted therein, blanks 15, such as tags for identifying potted plants, are produced from sheets 16 of polymeric material, such as polystyrene, which is die cut at cut lines 18 to divide the sheets into individual blanks. The die cutting operation leaves behind small portions of uncut material, referred to as bridges, (not shown) at the cut line between adjacent blanks 15 in order to keep the blanks assembled as sheets subsequent to the die cutting step. Sheets 16 are typically printed on one or both surfaces with the graphics required for each tag before the die cutting step. The sheets 16 are assembled into stacks 20 which may include one hundred or more sheets to facilitate separating an entire stacked group of tags 15, designated bundles 22, from the sheets. The method and apparatus according to the present invention strips one bundle 22 from stack 20 and processes the tags in the bundle into a commercially-sold unit by subsequently tying the bundle 22 with a tie 24 to form a tied bundle 25.

Referring to FIG. 2, a tag stripping and tying apparatus 26 includes a material feed assembly 28 for feeding stacks 20 to the apparatus, a dual stripping assembly 30 for stripping bundles of tags from the sheet stack and a tying assembly 32 for tying bundles. The tied bundles are discharged at discharge portion 34 onto a power conveyor 36 for transportation to a final packing area.

Stripping assembly 30 includes first and second stripping members 38*a* and 38*b*, respectively (FIGS. 3, 4, 5*a*, 5*b* and 11). Each stripping member 38*a*, 38*b* includes a stationary clamping assembly 40 and a movable clamping assembly 42. Movable clamping assembly 42 pivots with respect to stationary clamping assembly 40 about a pivot axis 44 which is laterally extending parallel to the cut lines 18 in the sheets 16 as the sheets are fed to the stripping assembly. Stationary clamping assembly 40 includes a stationary support member 45, having a generally planar stationary support surface 46, and a clamping member 48, which is mounted for reciprocal movement with respect to surface 46 and is urged toward surface 46 by a bellow 50. Bellow 50 includes a lower end portion 52 attached to clamping member 48 and an upper end portion 54 rigidly attached to a crosspiece portion of a rigid upright support 56.

Figure 5A:
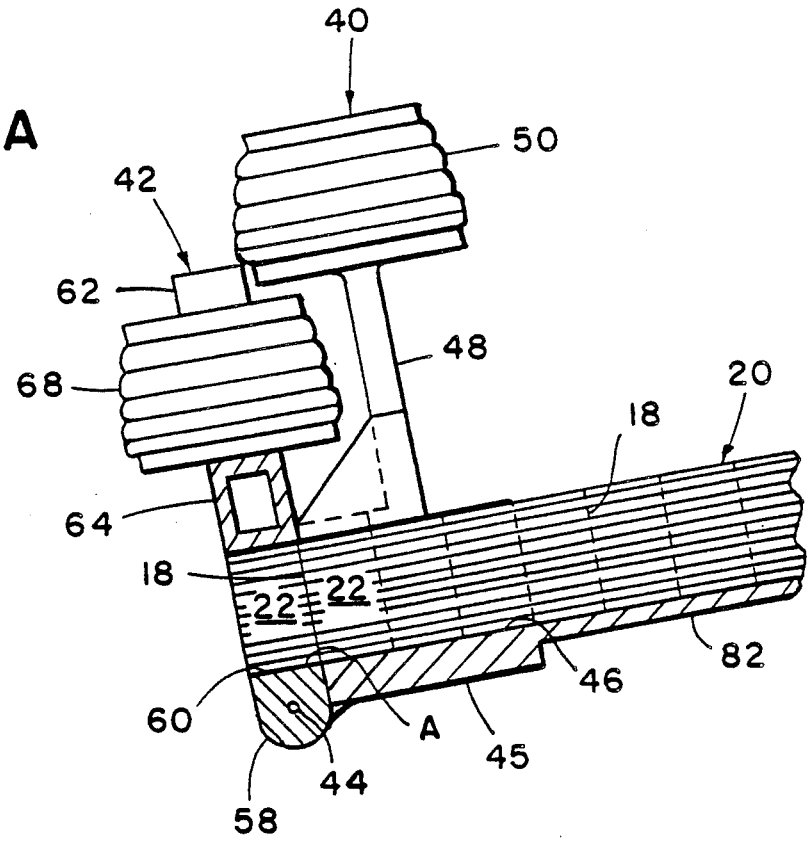
FIGS. 5*a* and 5*b* are illustrations of the method according to the invention.
Figure 5B:
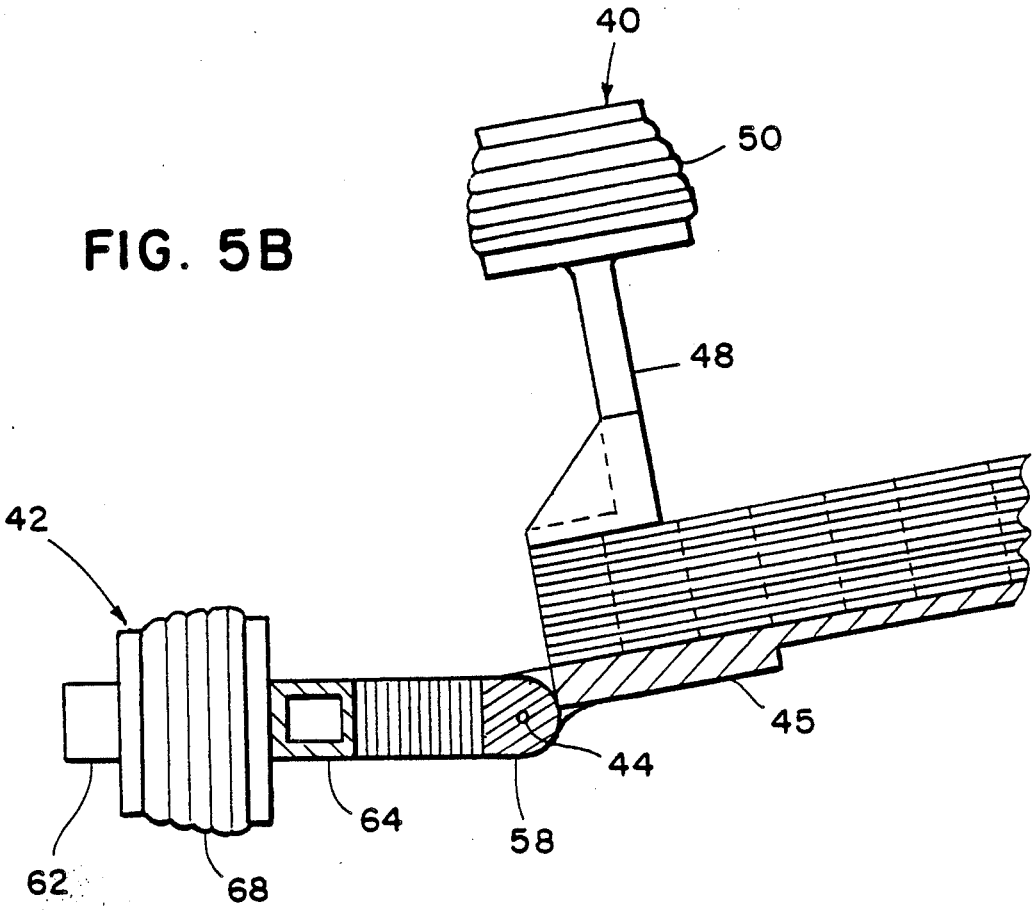
Figure 6:
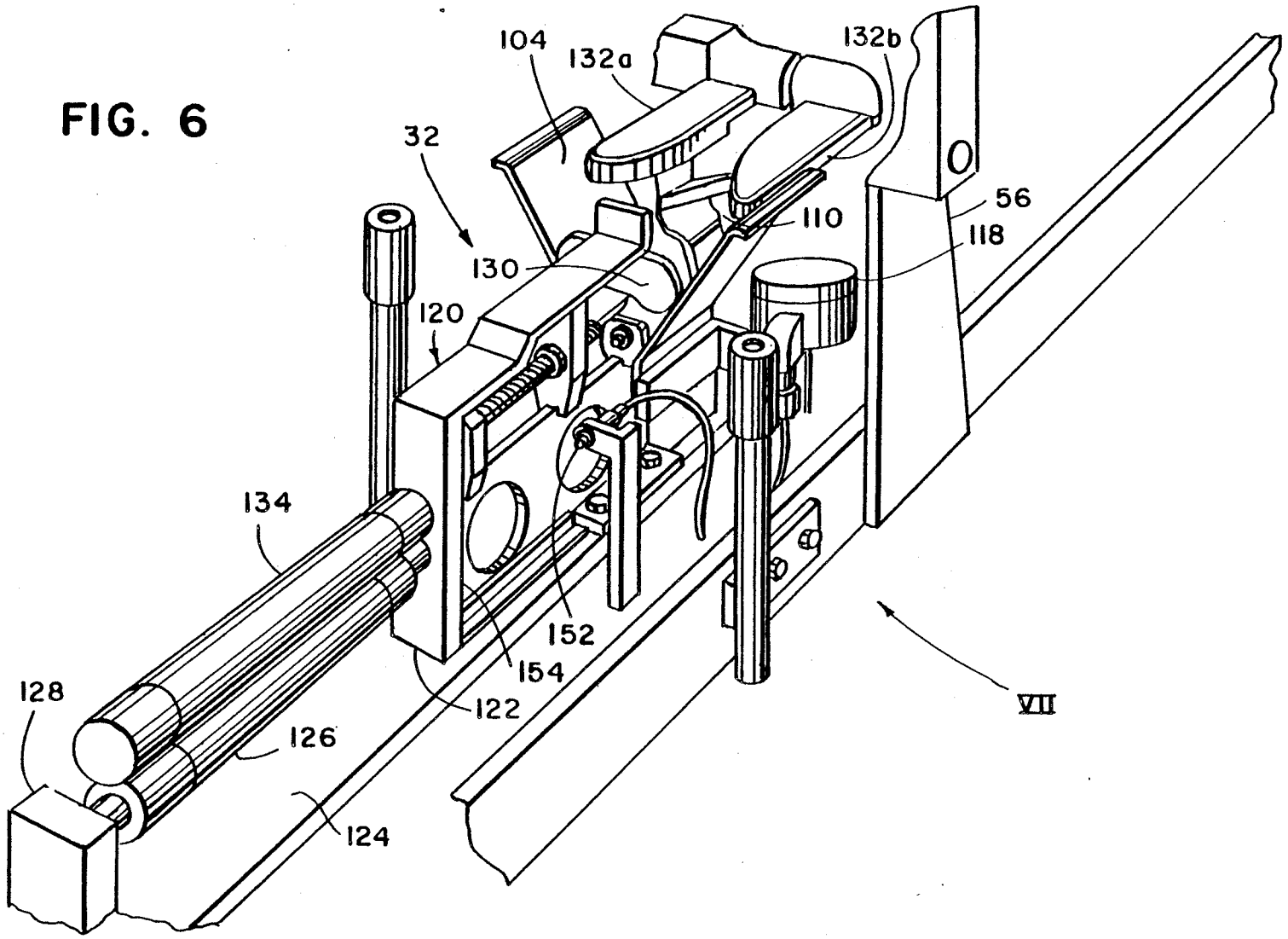
FIG. 6 is a partial perspective view of the right front side of the apparatus in FIG. 2 as observed along the line VI in FIG. 2.
Figure 7:
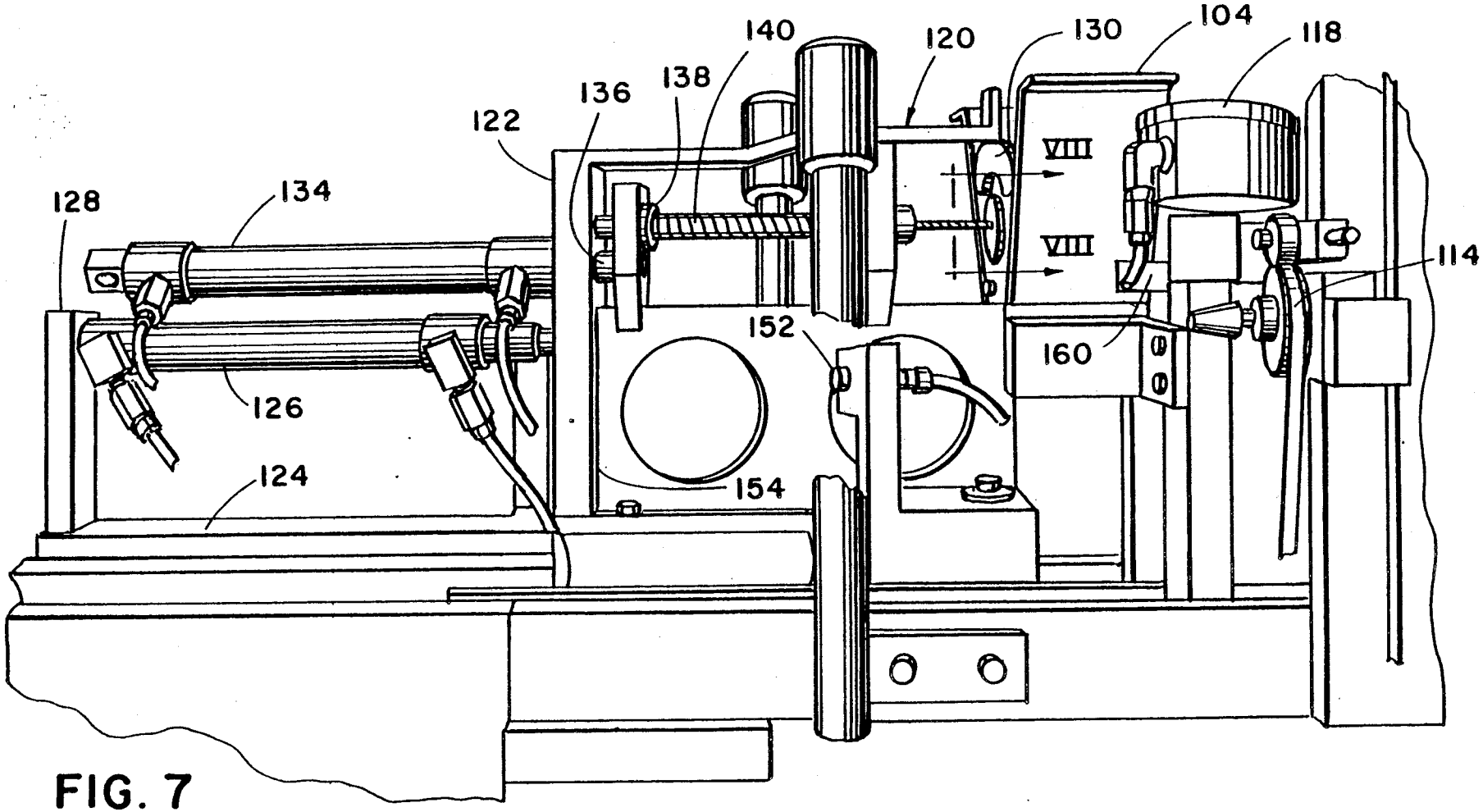
FIG. 7 is a partial elevational view of the right side of the apparatus in FIG. 2 as observed along the line VII in FIG. 6.

Movable clamping assembly 42 includes a movable support member 58, which is pivotable about axis 44 and has a generally planar support surface 60 Support surface 60 is planarly aligned with stationary support surface 46 when movable clamping assembly 42 is in that position illustrated in FIG. 5*a* and is longitudinally and angularly displaced with respect to stationary support surface 46 when movable clamping assembly 42 is in the position illustrated in FIG. 5*b*. Movable clamping assembly 42 further includes a rotatable arm 62 extending upwardly from support member 58 and rotatable therewith and a clamping member 64 mounted to a lower end portion 66 of a bellow 68, whose upper end portion 70 is rigidly attached with a cantilevered beam portion 72 of rotatable arm 62. In the illustrated embodiment, bellows 50 and 68 are commercially available and are sold by Firestone Corporation under Model 1M1A. Movable clamping assembly 42 further includes a stop 75 rigidly attached forwardly to movable arm 62 to index stacks 20 fed to the stripping assembly with the lead bundle 22 in proper position on movable support surface 60 and a guide 74 for assisting the removal by gravity of a stripped bundle of tags from the movable clamp assembly, as will be further described below. Movable clamping assembly 42 is rotated about axis 44 between the positions illustrated in FIGS. 5*a* and 5*b* by a pneumatic cylinder 76, which extends between arm 62 and a stationary bracket 78 attached to upright support 56. A booster cylinder 77, which is actuated concurrently with cylinder 76, is attached at one end to stationary bracket 78 and at an opposite end to a sliding member 79. Booster cylinder 77 places an assisting force on movable clamping assembly 42 at the beginning portion of its movement, if necessary, to initiate the stripping step. Sliding member 79 is spaced away from arm 62 and thus contacts the arm only after a delay and therefore, only applies a force on the movable clamping assembly if it has not been moved by cylinder 76.

Material feed assembly 28 is defined by a chute 80, having a bottom wall 82 and a pair of lateral sidewalls providing an upwardly opening channel-shaped cross section that is configured to the narrow dimension of stacks 20 and is mounted downwardly sloping toward stripping assembly 30 with bottom wall 82 being coplanarly attached with stationary support surface 46 (FIG. 5*a*). Chute 80 is further supported by brackets 78.

The stripping of bundles 22 from stack 20 is effected by selectively pressurizing bellows 50 and 68 and pneumatic cylinders 76. The bellows and cylinders are operated from a 90 PSI air source, which is substantially less than the pressure utilized to operate conventional tag stripping machines. The actuation of the bellows and cylinders is by operation of pneumatic solenoid valves (not shown) upon command from electrical control means 84. Control means 84 receives inputs from proximity sensors 86 associated with each movable clamping assembly 42 to provide an indication when the associated movable clamp assembly is in the position illustrated in FIG. 5*b*. Each proximity sensor 86 is positioned by a rigid vertical rod 69 and is surrounded by a resilient shock absorbing member 90 which extends above the sensor in order to provide a cushion for absorbing the impact of stopping the associated arm 62.

Control 84 additionally receives inputs from photo sensors 92*a*, 92*b* which each transmit and receive a beam of light through an associated fiber optic cable 96*a*, 96*b* when a light reflecting surface positioned in front of the terminal end of the associated fiber optic cable. The terminal end of each fiber optic cable is positioned adjacent the associated movable support surface 60. Tags 15 are laid out on sheets 16 in a staggered fashion with narrowed portions 17 of all tags aligned down the central longitudinal axis of the sheets and wider portions 19 of adjacent tags alternatingly offset in opposite lateral directions longitudinally along the sheets 16 (FIG. 1*a*). The function of the photo sensors 92*a*, 92*b* is to indicate to control 84 which movable support surface 60 has positioned therein a bunch of tags to strip from the stack so that control 84 will actuate the appropriate stripping member 38*a*, 38*b*. The operation of apparatus 26 produces copious quantities of debris left over from the die cutting step. In order to continually clear debris from the terminal ends of fiber optic cables 96*a* and 96*b*, apparatus 26 includes a cavity 98 defined in wall 99 of the stationary clamping assembly surrounding the terminal end of the associated fiber optic cables 96*a*, 96*b* and a low volume source of air or like fluid 100 which is discharged in pulses through tube 102 into cavity 98. The moving fluid continually washes the discharge surface of the respective fiber optic cable and prevents debris from settling on the surface.

Stripping members 38*a* and 38*b* alternatingly sequence in order to remove the staggered bundles 22 from stack 20. The bundles are stripped from the sheet by the simultaneous actuation of bellows 50 and 68 of the associated stripping member 38 and the subsequent actuation of the associated pneumatic cylinders 76 and 77 to rotate the movable clamping assembly 42 from the position illustrated in FIG. 5*a* to the position illustrated in FIG. 5*b*. When the movable clamping assembly 42 is in the position illustrated in FIG. 5*b*, bellows 50 and 68 are deactuated, which causes the bundle grasped between clamping member 64 and support member 58 to be released. The released bundle pivots about guide 75 to an orientation with the narrow portion 17 facing downwardly and falls due to the force of gravity. The bundle is received within a V-shaped trough 104, whose converging surfaces align the bundle 22 into a substantially vertical orientation with wider portions 19 above the narrow portions.

Each bundle of tags 22 received in trough 104 is tied by tying assembly 32 (FIGS. 6–10). Tying assembly 32 includes a payout mechanism 106 (FIG. 3) for throwing a predetermined length of wire 108 across a path 110 defined downstream of trough 104. Payout mechanism 106 includes a shaft and bearing assembly 112 which rotates a pulley 114 and is rotated by an upwardly biased rack 116 which is forced downwardly by a pneumatic cylinder 117. When rack 116 reaches its downward travel limit, cylinder 117 stalls and shaft assembly 112 stops rotating pulley 114. In this manner, pulley 114 is constrained to a predetermined number of revolutions established by the length of rack 116. Because pulley 114 is of fixed, known diameter, a predetermined length of wire 108, sufficient to extend fully across path 110, is paid out whenever cylinder 117 is energized. A bellows-actuated cutter 118 is actuated when cylinder 117 makes contact with a pneumatic switch 119 at the end of its stroke to cut wire 108 into a predetermined length. Photodetector 160, positioned on the side of path 110 opposite payout mechanism 106, senses the presence of the leading edge of the wire 108 and provides an indication to control 84 that a wire is in place. If such indication is not received when rack 116 reaches the end of its movement and cutter 118 is actuated, then control 84 determines that the apparatus 26 is out of wire and ceases further operation.

Tying assembly 32 includes a tying member 120 that is positioned upstream of trough 104 and has a longitudinally oriented frame member 122 which is longitudinally reciprocated with respect to a stationary base portion 124 of apparatus 26 by a pneumatic cylinder 126 extending between frame member 122 and an upward extension 128 of base portion 124. Actuation of pneumatic cylinder 126 moves frame member 122 downstream in the direction of trough 104. A pusher 130, positioned on a leading edge of frame member 122, pushes a tag bundle positioned in trough 104, forwardly along path 110. The movement of pusher 130 forces the bundle present in the through downstream between a converging pair of guides 132*a* and 132*b*, that are spaced apart the width of the wide portions 19 of the tags, against a portion of wire 108 that is positioned across path 110 in the manner previously descried. The movement of the bundle deforms the portion of wire 108 in path 110 around the bundle with the wire portion extending around three of the four contiguous sides of the bundle and the end portions both facing in the upstream direction of typing member 120. When pneumatic cylinder 126 is fully extended and the wire is formed around three sides of the bundle in this manner, a laterally widened portion 154 of frame member 122 contacts a pneumatic switch 152, which actuates a pneumatic cylinder 134, attached to frame member 122. Cylinder 134 includes a reciprocal ram 136 which moves a ball-nut 138 longitudinally along an elongated screw member 140. The extension of ram 136 causes nut 138 to rotate screw member 140 which imparts a rotary motion on a twisting member 142 positioned on the downstream end of screw member 140.

Twisting member 142, which is illustrated in more detail in FIGS. 8 and 9, includes a pair of fingers 144*a* and 144*b* extending radially outwardly from a center shaft 146 and curved radially outwardly in a spiral fashion in the direction of rotation of member 142. When twisting member 142 is rotated in response to the actuation of pneumatic cylinder 134, fingers 144*a* and 144*b* will snare and twist the opposite ends of the wire portion snugly against the surface of the tag bundle facing the rotating fingers. The contour of the fingers tends to draw the wire ends inwardly towards shaft 146 which causes the twisting member to draw the wire tightly around the bundle 22 to form a tied bundle 25. The control 84 responds to a limit switch (not shown) indicating that cylinder 134 is fully extended, and that the tying operation is thus complete, by retracting cylinders 126 and 134.

Figure 10:
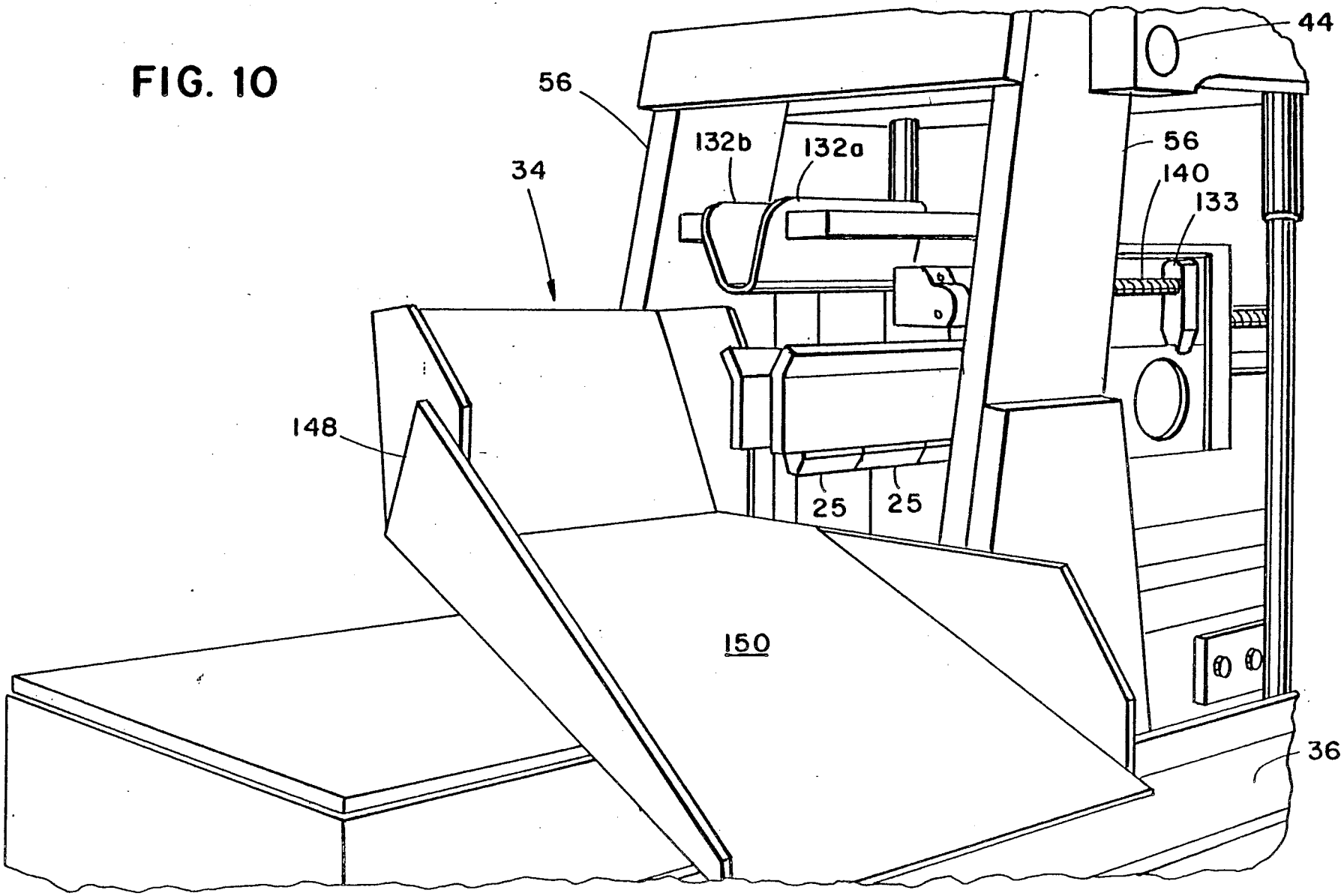
FIG. 10 is a partial perspective view of the left rear side of the apparatus in FIG. 2 as observed along the line X in FIG. 2.

As best seen in FIG. 10, guides 132*a* and 132*b* are elongated and extend downstream to discharge portion 34 and terminate vertically above a discharge chute 148. Discharge chute 148 has a downwardly sloping bottom surface 150 which directs tied bundles 25, deposited by gravity from guides 132*a*, 132*b*, onto powered conveyor 36. Tied bundles 25 are moved along guides 132*a*, 132*b* toward discharge portion 34 by the force of subsequent bundles of tags being pushed onto the guides by pusher 130.

A master pneumatic cutoff switch 156 (FIG. 4) is positioned within easy reach of a human operator in order to allow the operator to cut the supply of compressed air to the bellows and pneumatic cylinders that operate the tag stripping and tying apparatus 26. This provides a convenient "kill" switch to stop apparatus 26 whenever necessary, such as during a condition when the integrity of a bundle of tags, which include low friction surfaces, is disrupted. Once the jam is cleared, switch 156 is actuated to resume operation of the apparatus.

OPERATION

With a stack 20 of die cut sheets 16 positioned in chute 80, the leading bundle 22 of tags 15 will rest against the respective stop 75 to properly index the bundle. The appropriate photo sensor 92*a*, 92*b* will indicate to control 84 the presence of a bundle 22 on the associated movable support surface 60. Control 84 responds to the indication from sensor 92*a* or 92*b* by energizing the associated bellows 50 and 68 in order to clamp the stack 20 in the manner illustrated in FIG. 5*a*. After a brief delay, sufficient to allow the bellows to fully extend, the associated pneumatic cylinder 76 is actuated to rotate the movable clamp assembly 42 from the position illustrated in FIG. 5*a* to that illustrated in FIG. 5*b*. This movement rotates the bundle 22 clamped within a movable clamp assembly 42, away from the adjacent bundle 22 clamped in stationary clamping assembly 40 while simultaneously placing an upward force at location A (FIG. 5*a*) adjacent the cut line 18. If pneumatic cylinder 76 is slow at rotating the movable clamp assembly, due to manufacturing tolerances in the previous die cutting step, booster cylinder 77 will cause member 79 to contact arm 62 to initiate the stripping process. The force in the direction transverse the plane of sheets 16 is exerted as a result of axis 44 being positioned substantially as close to movable support surface 60 as it is from the closest portion of support member 45. This positioning of axis 44 causes point A of surface 60 to move upwardly as surface 60 pivots counterclockwise as seen in FIG. 5*a*. The upward force on the interface between the bundles in the clamp assemblies in combination with the rotation of the bundles, causes a tension between adjacent tags, sufficient to break the adjoining bridges, sequentially on successive sheets in order to break all bridges joining the stack in the movable clamping assembly from that in the stationary clamping assembly. Because the bridges are broken sequentially rather than simultaneously, a much reduced force is required to strip the bundle 22 in the movable clamp assembly from the adjacent bundle in the stationary clamp assembly.

When the movable clamp assembly 42 reaches the position illustrated in FIG. 5*b*, an indication is provided to control 84 from the associated proximity sensor 86. The control responds by deactuating bellows 50 and 68. The deactuation of bellow 50 allows the remaining portion of stack 20 to slide down chute 80 under the force of gravity until the leading edge of the lead bundle 22, which will be oriented on the opposite lateral side of stack 20 from the bundle just stripped from the stack, abuts stop 75. The deactuation of bellow 68 causes the just-stripped bundle 22 to be released from movable clamp assembly 42, pivot about guide 74 and fall under the force of gravity into trough 104 whose converging sidewalls will align the stack into a vertical orientation with the narrow portion downward. While the stripping step is carried out, payout mechanism 106 is actuated to pay out a predetermined length of wire 108 across path 110.

Control 84 responds, after a predetermined time delay, to an indication from a proximity sensor 86 that its associated movable clamp assembly has moved to the position illustrated in FIG. 5*b*, by actuating cylinder 126. The delay is provided in order to allow time for the movable clamp assembly to release the stripped bundle and for the bundle to drop into position in trough 104. The actuation of cylinder 126 moves frame member 122 and pusher 130 mounted thereon forwardly downstream, which pushes the stripped bundle of tags into the predetermined length of wire 108 positioned across path 110. This causes the wire to wrap around three sides of the bundle with the opposite end portions extending in the upstream direction toward tying member 120. When pneumatic switch 152 is contacted by frame member 122 being positioned fully forward, cylinder 134 is actuated, which moves nut 138 longitudinally along screw 140, which causes rotation of the screw and the twisting member 142. The rotation of twisting member 142 causes its fingers 144*a* and 144*b* to catch and twist the wire ends until the wire is snug against the bundle of tags. If the stripped tag bundle disassociates in trough 104, forward motion of pusher 130, and hence frame 122, will be impeded. This will prevent actuation of switch 152 and the apparatus 26 will cease operation, until cleared. When cylinder 134 is fully extended, control 84 responds to the signal from a limit switch (not shown) and retracts cylinders 134 and 126. Once cylinders 134 and 126 are fully retracted, as indicated by a proximity sensor (not shown), control 84 initiates another stripping cycle at the stripping member 38*a* or 38*b* whose associated photo sensor 92*a* or 92*b* indicates that a bundle 22 is properly positioned on the associated movable support surface 60.

Because the bundles 22 are alternatingly staggered on stacks 20, the stripping members 38*a* and 38*b* will alternate in the previously-described cycle of stripping a bundle from the stack and discharging the stack to chute 104, where the bundle is tied by tying member 120. Because stripping members 38*a* and 38*b* are alternatingly operated, only the bellows 50 and 68 associated with the one stripping member 38 that is presently stripping are actuated. The other set of bellows is dormant. This further reduces the consumption of pneumatic air energy by the apparatus.

The significantly reduced clamping force required to practice the method of the invention, by the embodiment of the apparatus set forth herein, as compared with previously-known techniques, provides numerous advantages. The apparatus can be made much more compact, with smaller parts that are required to take much less strain. Notwithstanding their smaller size, the components are subject to less frequent maintenance and replacement because strain has been so significantly reduced. Most importantly, the forces required to practice the present invention are reduced to a level that safety shields are no longer a necessity to protect human appendages from serious injury. The absence of safety shields allows the apparatus to be shut down and cleared of jams and put back into service in a fraction of the time of previously-known machines. This, in combination with the enhanced design and function provided by the invention, provides a level of productivity that greatly exceeds that of previously-known machines.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows.

1. An apparatus for severing blanks of a stack of die cut sheets comprising:

first clamping means for clamping a batch of die cut sheets on one side of a cut line;

second clamping means for clamping a batch of die cut sheets on the side of a cut line opposite said one side; and means for rotating one of said clamping means with respect to the other one of said clamping means about an axis parallel to the plane of the die cut sheets and spaced from the plane defined by said cut lines in order to sequentially separate individual sheets at said cut line.

2. The apparatus in claim 1 further including means for applying a shear force adjacent the cut line in a direction transverse the plane of sheets in the stack.

3. The apparatus in claim 1 in which said first clamping means includes a stationary support platform, a first clamping member and means for extending said clamping member toward said stationary support platform to press die cut sheets against said stationary platform, in which said second clamping means includes a movable support platform, a second clamping member and means extending said second clamping member toward said movable support platform to press die cut sheets against said movable platform and wherein said movable platform is rotatable about said axis.

4. The apparatus in claim 3 in which said support platforms include generally planar support surfaces and adjacent portions that are closely spaced when said support surfaces are coplanar and wherein said axis is positioned substantially at least as close to said support surface on said movable platform as to said adjacent portion of said stationary platform in order to place a shear force on the sheets in a direction transverse to said planar support surfaces.

5. An apparatus for severing blanks of a stack of die cut sheets comprising:

a stationary support surface;

first means for pressing die cut sheets against said stationary support surface;

a rotatable assembly including a rotatable support surface, second means for pressing die cut sheets against said rotatable support surface, and rotating means for rotating said rotatable assembly between a first position in which said support surfaces are substantially coplanar and a second position in which said support surfaces are not substantially coplanar;

wherein said rotating means rotates said rotatable assembly between said positions about an axis parallel to the plane of the die cut sheets and spaced from the plane defined by said cut lines in order to sequentially separate individual sheets at said cut line; and feed means for feeding stacks of die cut sheets to said support surfaces including indexing means for indexing stacks of sheets with at least one stack of blanks on said stationary support surface and an adjacent stack of blanks on said rotatable support surface.

6. An apparatus for severing blanks of a stack of die cut sheets comprising:

a stationary support surface;

first means for pressing die cut sheets against said stationary support surface;

a rotatable assembly including a rotatable support surface, second means for pressing die cut sheets against said rotatable support surface, and rotating means for rotating said rotatable assembly between a first position in which said support surfaces are substantially coplanar and a second position in which said support surfaces are not substantially coplanar;

means for rotating said rotatable assembly between said position;

feed means for feeding stacks of die cut sheets to said support surfaces including indexing means for indexing stacks of sheets with at least one stack of blanks on said stationary support surface and an adjacent stack of blanks on said rotatable support surface; and wherein said feed means includes an elongated chute extending from said stationary support surface, said chute being on an incline upwardly away from said stationary support surface.

7. An apparatus for severing blanks of a stack of die cut sheets comprising:

a stationary support surface;

first means for pressing die cut sheets against said stationary support surface;

a rotatable assembly including a rotatable support surface, second means for pressing die cut sheets against said rotatable support surface, and rotating means for rotating said rotatable assembly between a first position in which said support surfaces are substantially coplanar and a second position in which said support surfaces are not substantially coplanar;

means for rotating said rotatable assembly between said positions;

feed means for feeding stacks of die cut sheets to said support surfaces including indexing means for indexing stacks of sheets with at least one stack of blanks on said stationary support surface and an adjacent stack of blanks on said rotatable support surface; and wherein said indexing means includes stop means on said rotatable assembly located in a manner to position the leading stack of blanks on said rotatable support surface.

8. An apparatus for severing blanks of a stack of die cut sheets comprising:

a stationary support surface;

first means for pressing die cut sheets against said stationary support surface;

a rotatable assembly including a rotatable support surface, second means for pressing die cut sheets against said rotatable support surface, and rotating means for rotating said rotatable assembly between a first position in which said support surfaces are substantially coplanar and a second position in which said support surfaces are not substantially coplanar;

means for rotating said rotatable assembly between said positions;

feed means for feeding stacks of die cut sheets to said support surfaces including indexing means for indexing stacks of sheets with at least one stack of blanks on said stationary support surface and an adjacent stack of blanks on said rotatable support surface; and control means for controlling the sequence of operation of said pressing means and said rotating means, said control means including first sensing means for sensing the presence of sheets on said rotatable support surface, second sensing means for sensing said head being in said second position and means responsive to said first and second sensing means for causing said pressing means to press the sheets against the association support surface and said head to move to said second position when sheets are present on said rotatable support surface and for causing said rotating means to rotate said rotatable assembly to said first position and said pressing means to release the sheets when said head is in said second position.

9. The apparatus in claim 8 in which said first sensing means includes light sensor means for emitting a beam of light adjacent said rotatable support surface, and for receiving said beam of light when reflected by an object on said rotatable support surface and means for passing a stream of fluid across said light emitting means to keep debris from interrupting said beam.

10. The apparatus in claim 8 in which said second sensing means includes proximity sensing means for sensing the proximity of said rotatable assembly and shock absorbing means for absorbing terminal movement of said rotatable assembly toward said proximity sensing means.

11. An apparatus for severing blanks of a stack of die cut sheets comprising:

a stationary support surface;

first means for pressing die cut sheets against said stationary support surface;

a rotatable assembly including a rotatable support surface, second means for pressing die cut sheets against said rotatable support surface, and rotating means for rotating said rotatable assembly between a first position in which said support surfaces are substantially coplanar and a second position in which said support surfaces are not substantially coplanar;

means for rotating said rotatable assembly between said positions;

feed means for feeding stacks of die cut sheets to said support surfaces including indexing means for indexing stacks of sheets with at least one stack of blanks on said stationary support surface and an adjacent stack of blanks on said rotatable support surface; and receiving means for receiving blanks separated from sheets and tying means for tying bundles of blanks together.

12. The apparatus in claim 11 in which said tying means includes means for throwing a portion of wire across a path, means for pushing a bundle of blanks along said path into a wire and means for twisting opposite ends of said wire together.

13. The apparatus in claim 12 in which said twisting means includes rotary means for snaring and rotating opposite ends of a portion of wire.

14. The apparatus in claim 13 in which said path is defined by a pair of parallel wall members spaced apart the width of a bundle of blanks.

15. The apparatus in claim 14 in which said means for rotary means is positioned on said pushing means and is actuated in response to said pushing means being fully extended.

16. A method for producing bundles of blanks from a stack of die cut sheets including the steps of:

clamping portions of a stack of die cut sheets on opposite sides of a common cut line adjacent he location of the cut line; and rotating said portions about the common cut line with respect to each other about an axis parallel to the plane of said sheets and spaced from the plane defined by said cut lines in order to sequentially separate individual sheets at said cut line.

17. The method for producing bundles of blanks in claim 16 further including applying a shear force transverse the plane of the die cut sheets adjacent the cut line concurrently with said step of rotating.

18. A method for producing bundles of blanks for a stack of die cut sheets including the steps of:

clamping portions of a stack of die cut sheets on opposite sides of a common cut line adjacent the location of the cut line;

rotating said portions about he common cut line with respect to each other about an axis parallel to the plane of said sheets in order to sequentially separate individual sheets at said cut line;

applying a force transverse the plane of the die cut sheets adjacent the cut line concurrently with said step of rotating; and tying batches of blanks after said step of rotating.

19. The method for producing bundles of blanks in claim 18 in which said step of tying includes positioning a wire segment of predetermined length in a predetermined location, pushing a bundle of blanks into said wire to cause said wire to wrap at least partially around the bundle and twisting the ends of the wire.

20. The method for producing bundles of blanks in claim 19 in which said step of twisting includes contacting said ends of the wire with a rotating member having fingers adapted to snaring said ends of the wire.

21. An apparatus for severing blanks of a stack of die cut sheets, said blanks having enlarged portions alternatingly positioned on opposite lateral sides of said sheets, said apparatus comprising:

a feed assembly adapted to feed a stack of sheets longitudinally to a stripping assembly;

said stripping assembly including first and second laterally positioned stripping members, each of said stripping members including stationary clamping means actuatable for clamping a stack of sheets, movable clamping means positioned adjacent said stationary clamping means away from said feed assembly and means for rotating said movable clamping means about a laterally extending axis; and control means for sensing the presence of a portion of a stack in one of said movable clamping assemblies and for actuating the said clamping assemblies and the said rotating means associated with the said one of said movable clamping assemblies in response to the presence of a portion of a stack in said one of said movable clamping assemblies.

22. The apparatus in claim 21 in which said sensing means includes a sensor positioned adjacent the associated said movable clamping assembly and fluid flow means for causing a cleansing fluid to flow across said sensor to reduce the deposition of debris on said sensor.

23. The apparatus in claim 21 in which each of said stationary and said movable clamping means includes a support surface, a clamping member and a fluid-actuated bellow actuatable for biasing said clamping member toward the associated said support surface.

24. The apparatus in claim 21 further including a pair of laterally-spaced wall means defining a trough positioned laterally between and vertically below said stripping members, and guide means associated with said stripping members for guiding bundles of blanks severed from a stack of die cut sheets in a predetermined orientation into said trough.

25. The apparatus in claim 24 further including payout means for throwing a predetermined length of wire in a path aligned with said trough and pushing means for pushing a bundle of blanks into said path, such that a wire in said path will wrap at least partially around the bundle of blanks.

26. The apparatus in claim 25 further including rotatable twisting means having a pair of radially extending arms adapted to snaring a pair of generally aligned wire ends and means for moving said twisting means toward said path.

27. The apparatus in claim 25 in which said payout means includes a pulley aligned with said path for paying out wire, means for rotating said pulley a predetermined number of turns and cutting means associated with said pulley for cutting wire.

28. The apparatus in claim 27 in which said rotating means includes a shaft on which said pulley is mounted, an elongated member tangentially engaging said shaft and means for longitudinally extending said elongated member a predetermined length.

29. The apparatus in claim 28 further including switch means responsive to said elongated member being longitudinally extended for actuating said cutting means.

* * * * *

UNITED STATES PATENT AND TRADEMARK OFFICE

CERTIFICATE OF CORRECTION

PATENT NO. : 4,987,723

DATED : January 29, 1991

INVENTOR(S) : Gordon J. Diemer

It is certified that error appears in the above-identified patent and that said Letters Patent is hereby corrected as shown below:

Column 3, line 14
After "60" insert --.--;
Column 5, line 25
"through" should be --trough--;
Column 5, line 34
"typing" should be --tying--;
Column 11, line 14
"adjacent he" should be --adjacent the--;
Column 11, line 30
"about he" should be --about the--.

Signed and Sealed this

Eighteenth Day of August, 1992

*Attest:*

DOUGLAS B. COMER

*Attesting Officer*

*Acting Commissioner of Patents and Trademarks*